US010154571B2

(12) United States Patent
Lai et al.

(10) Patent No.: US 10,154,571 B2
(45) Date of Patent: Dec. 11, 2018

(54) CONNECTOR FOR CONNECTING A LAMP TO A POWER SOURCE

(71) Applicant: Sky Light Electronic (Shenzhen) Limited Corporation, Shenzhen (CN)

(72) Inventors: Chung Man Lai, Shenzhen (CN); XinJie Mo, Shenzhen (CN); RiMing Fang, Shenzhen (CN)

( * ) Notice: Subject to any disclaimer, the term of this patent is extended or adjusted under 35 U.S.C. 154(b) by 116 days.

(21) Appl. No.: 15/169,672

(22) Filed: May 31, 2016

(65) Prior Publication Data

US 2017/0343200 A1 Nov. 30, 2017

(51) Int. Cl.

| | |
|---|---|
| ***F21V 23/06*** | (2006.01) |
| ***F21V 23/04*** | (2006.01) |
| ***F21V 23/00*** | (2015.01) |
| ***H05B 37/02*** | (2006.01) |
| ***H01R 33/945*** | (2006.01) |
| *F21V 19/00* | (2006.01) |
| *H01R 24/60* | (2011.01) |

(52) U.S. Cl.

CPC ..... *H05B 37/0272* (2013.01); *H01R 33/9453* (2013.01); *F21V 19/006* (2013.01); *H01R 24/60* (2013.01)

(58) Field of Classification Search

CPC ..... F21V 23/06; F21V 23/04; F21V 15/015; H05B 37/0272

See application file for complete search history.

(56) References Cited

U.S. PATENT DOCUMENTS

| | | | | |
|---|---|---|---|---|
| 5,282,116 A * | 1/1994 | Shiau | F21L 2/00 | 200/60 |
| 6,290,522 B1 * | 9/2001 | Campolo | H01R 33/0854 | 439/241 |
| 9,631,798 B2 * | 4/2017 | Barry | F21V 19/02 | |

* cited by examiner

*Primary Examiner* — Joseph L Williams

(74) *Attorney, Agent, or Firm* — Prakash Nama; Global IP Services, PLLC

(57) ABSTRACT

Disclosed is a lamp holder, which includes a front housing, a rear housing detachably connected to one end of the front housing, an end cap detachably connected to the other end of the front housing and a first connecting cap provided in the rear housing for connecting with a lamp, and further includes a compression spring, a conducting sheet and a conducting pole for contacting with an external power source. When one end of the lamp holder is connected with an external lamp socket, the conducting pole can keep a good electrical connection with the external power source due to the action of the compression spring; and when the other end of the lamp holder is connected with the lamp, the resilient sheet can keep a good electrical connection with the lamp due to the resilient sheet.

17 Claims, 3 Drawing Sheets

CONNECTOR FOR CONNECTING A LAMP TO A POWER SOURCE

BACKGROUND OF THE INVENTION

The present invention relates to lighting technology and, in particular, it concerns a lamp holder.

Lamp holder is a connector for connecting a lamp to power source. One end of the lamp holder is connected to an external power source via a lamp socket and the other end of the lamp holder is connected with a lamp, such as a lamp bulb. In the existing technology, the lamp holder is connected with the lamp and the lamp socket by means of thread connection or socket connection, which will generally cause a connection between the lamp holder and the lamp to be too loose or too tight, thus, it is easy to cause the screw thread to be damaged or cause a bad contact.

BRIEF SUMMARY OF THE INVENTION

An object of the present invention is to provide a lamp holder, which has good reliability and stability and has longer service life, so as to overcome the defects of the prior art.

To achieve the above object, there is provided a lamp holder, which includes a lamp holder, comprising a front housing, a rear housing detachably connected to one end of the front housing, an end cap detachably connected to the other end of the front housing and a first connecting cap provided in the rear housing for connecting with a lamp, and further comprises a compression spring, a conducting sheet and a conducting pole for contacting with an external power source; the end cap has an axial through hole formed thereon and a limiting block formed on inner wall of the through hole for limiting the conducting pole; the conducting pole has a limiting ring formed thereon; one end of the conducting pole passes through the through hole, and the other end of the conducting pole is sleeved with the compression spring; and one end of the compression spring contacts with the limiting ring and the other end of the compression spring contacts with the conducting sheet which is fixed inside the end cap.

Preferably, the lamp holder further comprises a second connecting cap which is mounted on the end cap for connecting with an external lamp socket.

Preferably, the second connecting cap is provided with external thread for connecting with the external lamp socket.

Preferably, the first connecting cap is a cylindrical structure which is provided with internal thread therein, and a resilient sheet is fixed to an end of the first connecting cap for contacting with the lamp.

Preferably, the lamp holder further comprises a PCB board which is disposed inside a receiving chamber formed by the front housing and the rear housing together and is fixed to an end face of the rear housing.

Preferably, the PCB board is provided with a main control unit and a switch circuit electrically connected with the main control unit and controlled by a PWM control signal from the main control unit, the switch circuit having an input side provided for electrically connecting to the external power source and an output side provided for electrically connecting to the lamp.

Preferably, the switch circuit is silicon controlled rectifier.

Preferably, the PCB board is further provided with a wireless communication module, which is electrically connected with and controlled by the main control unit.

Preferably, the wireless communication module comprises at least one of a WIFI module and a Bluetooth module.

Preferably, the PCB board is further provided with an AC-DC buck converter, an input side of which is provided for electrically connecting to the external power source and an output side of which is electrically connected to the main control unit.

Preferably, the AC-DC buck converter comprises a rectification circuit, an AC-DC conversion circuit electrically connected with the rectification circuit and a DC-DC buck circuit electrically connected with the AC-DC conversion circuit, an input side of the rectification circuit being provided for electrically connecting to the external power source and an output side of the DC-DC buck circuit being electrically connected with the main control unit.

Preferably, the PCB board is further provided with an USB interface, which is disposed inside an opening formed on a sidewall of the front housing and electrically connected to an output side of the AC-DC conversion circuit.

Preferably, the lamp holder further comprises a rubber plug provided for inserting into the opening to cover the USB interface.

Preferably, the PCB board is further provided with an AC voltage sensing circuit, an input side of which is provided for electrically connecting to the external power source and an output side of which is electrically connected to the main control unit.

Preferably, the AC voltage sensing circuit comprises an isolation device and a voltage sampling circuit electrically connected with the isolation device, an input side of the isolation device being provided to electrically connect with the external power source and an output side of the voltage sampling circuit being electrically connected to the main control unit.

Preferably, the PCB board is further provided with a MFI authentication chip, which is connected with the main control unit.

Preferably, the main control unit is a microcontroller unit.

Compared with the prior art, the present invention has some beneficial effects as follows: when one end of the lamp holder is connected with an external lamp socket, the conducting pole can keep a good electrical connection with the external power source due to the action of the compression spring, even if the lamp holder connects with the lamp socket too loosely or too tightly; and when the other end of the lamp holder is connected with the lamp, the resilient sheet can keep a good electrical connection with the lamp due to the resilient sheet, even if the lamp holder connects with the lamp too loosely or too tightly.

The present invention will become more clearly by means of the following description combining the accompanying drawings, which are used to illustrate embodiments of the present invention.

DETAILED DESCRIPTION OF THE INVENTION

The technical solutions of embodiments will be clearly and completely described as follows by combining the figures of the embodiments of the present invention, and similar reference numbers in the figures represent similar components. Obviously, the embodiments described as follows are merely parts of embodiments of the present invention, but not the all. Based on the embodiments of the present invention, other embodiments created by one of ordinary skill in the art without creative work, all belong to the scope of protection of the present invention.

Figure 1:
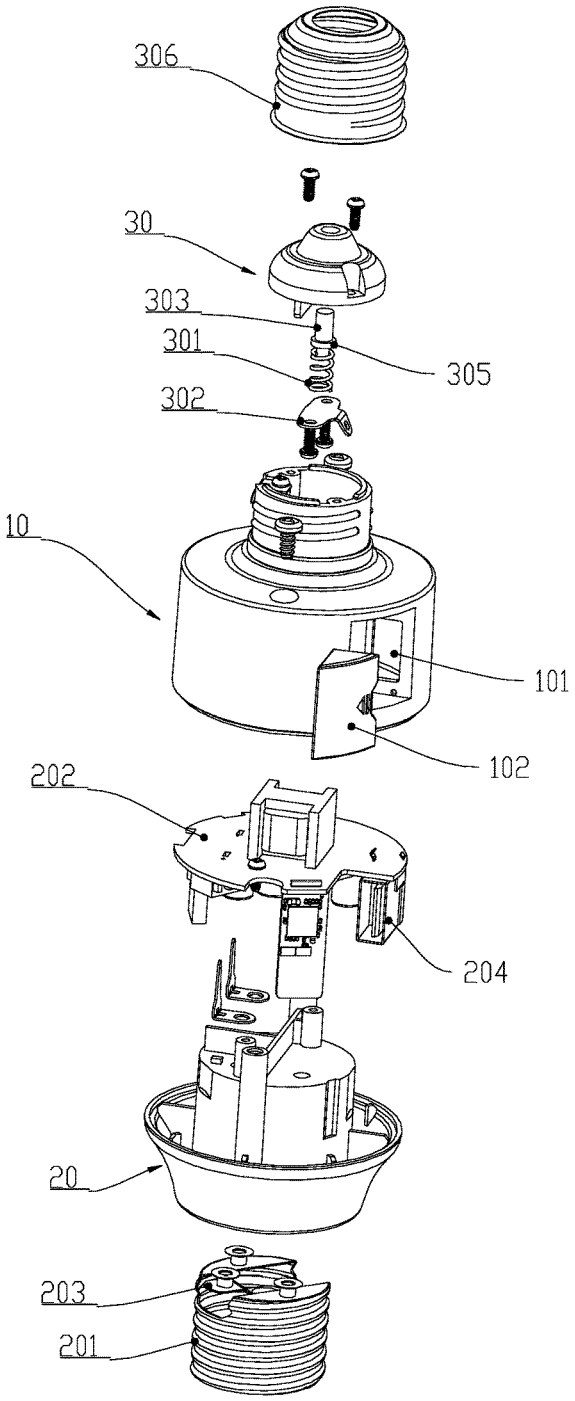
FIG. 1 is an exploded view of a lamp holder according to an embodiment of the present invention.
Figure 2:
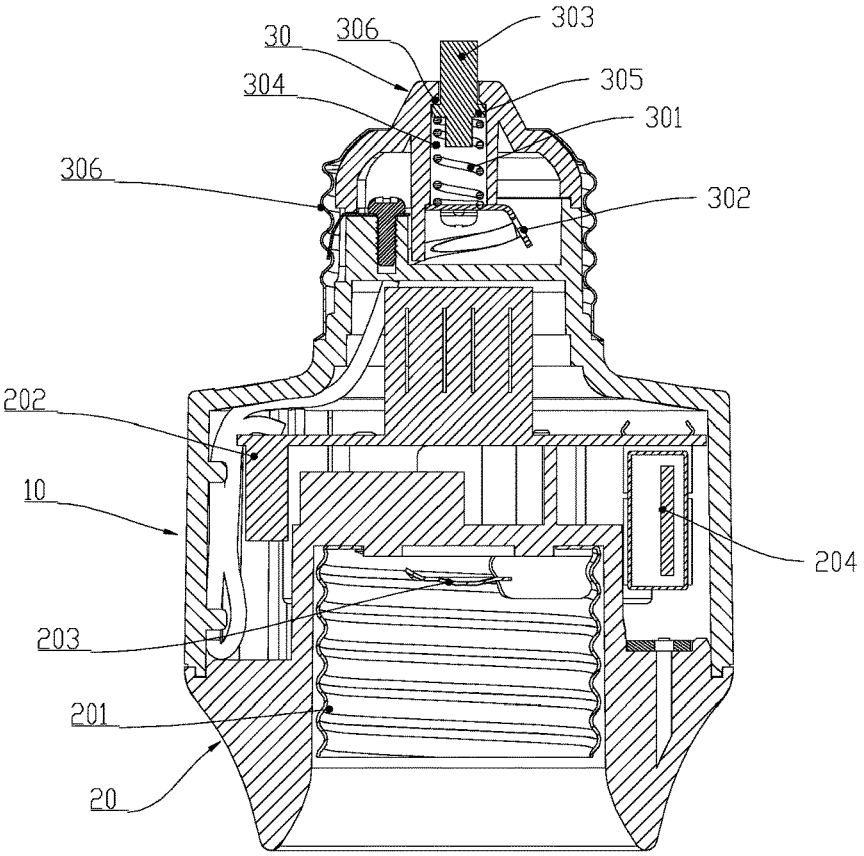
FIG. 2 is a section view of the lamp holder according to an embodiment of the present invention.
Figure 3:
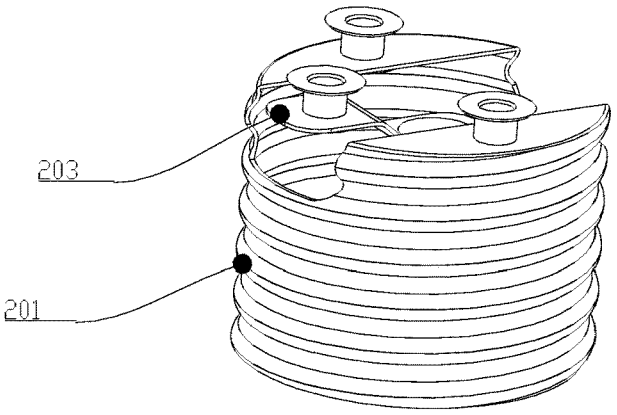
FIG. 3 is a perspective view of a first connecting cap of the intelligent lamp holder according to an embodiment of the present invention.

As shown in FIG. 1 and FIG. 2, the lamp holder includes a front housing 10, a rear housing 20 detachably connected to one end of the front housing 10, an end cap 30 detachably connected to the other end of the front housing 10, and a first connecting cap 201 provided in the rear housing 20 for accepting a lamp with a standard E5 to E27 lamp base (not shown in FIG. 1 to FIG. 3). The lamp holder further includes a compression spring 301, a conducting sheet 302 and a conducting pole 303 for contacting with external power source (not shown in FIG. 1 to FIG. 3); the end cap 30 has an axial through hole 304 formed thereon and a limiting block 306 formed on inner wall of the through hole 304 for limiting the conducting pole 303; the conducting pole 303 has a limiting ring 305 formed thereon; one end of the conducting pole 303 passes through the through hole 304, and the other end of the conducting pole 303 is sleeved with the compression spring 301; and one end of the compression spring 301 contacts with the limiting ring 305 and the other end of the compression spring 301 contacts with the conducting sheet 302 which is fixed inside the end cap 30.

In this embodiment, the lamp holder further includes a second connecting cap 306 which is mounted on the end cap 30 for connecting with an external lamp socket (not shown in Figures), such as a standard E5 to E27 base socket. The second connecting cap 306 is provided with external thread for connecting with the external lamp socket (not shown in Figures). The lamp holder further includes a PCB board 202 which is disposed inside a receiving chamber formed by the front housing 10 and the rear housing 20 together and fixedly connects with an end face of the rear housing 20. As shown in FIG. 3, the first connecting cap 201 is a cylindrical structure which is provided with internal thread therein, and a resilient sheet 203 is fixed to an end of the first connecting cap 201 for contacting with the lamp.

The conducting sheet 302 is fixed inside the end cap 30 by screw and the compression spring 301 is mounted inside the through hole 304. The conducting pole 303 is also mounted inside the through hole 304 and is able to move back and forth in the through hole 304. When the second connecting cap 306 is connected with the external lamp socket (not shown in Figures) by thread connection, the lamp holder can keep a good electrical connection with the external power source due to the conducting pole 303 even if the second connecting cap 306 connects with the lamp socket too loosely or too tightly. The resilient sheet 203 is fixed to an end of the first connecting cap 201 by screw. When the first connecting cap 201 is connected with the lamp (not shown in Figures) by thread connection, the lamp holder can keep a good electrical connection with the lamp due to the resilient sheet 203 even if the first connecting cap 201 connects with the lamp too loosely or too tightly.

Figure 4:
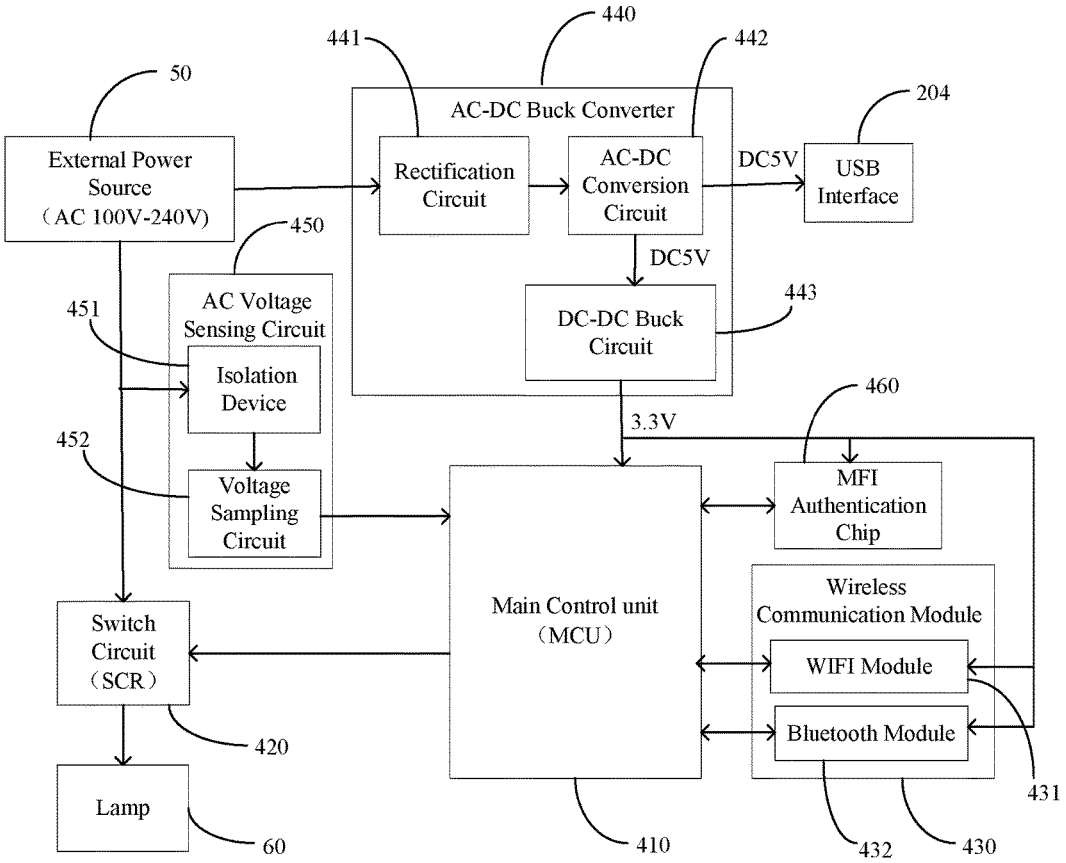
FIG. 4 is a block diagram illustrating a circuit configuration of the intelligent lamp holder according to an embodiment of the present invention.

Referring to FIG. 4, in this preferred embodiment, the lamp holder is an intelligent lamp holder and the PCB board 202 is provided with a main control unit 410 and a switch circuit 420 which is electrically connected with the main control unit 410 and controlled by a PWM control signal from the main control unit 410. An input side of the switch circuit 420 is electrically connected to the first connecting cap 201 so as to electrically connect to the external power source 50 and an output side thereof is provided for electrically connecting to the lamp 60 via the second connecting cap 306. In this preferred embodiment, a silicon controlled rectifier, such as BT136, is provided as the switch circuit 420 and a microcontroller unit, such as STM32FXX, is provided as the main control unit 410. The microcontroller unit (MCU) is electrically connected with the silicon controlled rectifier (SCR) via general purpose input output (GPIO) thereof, thus, a conduction angle of the SCR can be controlled by the PWM control signal sent by the MCU and then the switch control and brightness adjustment of the lamp 60 can be achieved.

Preferably, the PCB board 202 is further provided with a wireless communication module 430, which is electrically connected with and controlled by the main control unit 410. In this preferred embodiment, the wireless communication module 430 includes a WIFI module 431 and a Bluetooth module 432. Both of the WIFI module 431 and the Bluetooth module 432 are electrically connected to the main control unit 410. Based on this, the intelligent lamp holder of the present invention can build communication with an external mobile terminal, such as mobile phone, tablet computer and so on. It should be noted that in some other embodiments, the wireless communication module 430 could only include a WIFI module 431 or a Bluetooth module 432 according to actual need.

Preferably, the PCB board 202 is further provided with an AC-DC buck converter 440, an input side of which is provided for electrically connecting to the external power source 50 and an output side of which is electrically connected to the main control unit 410. In this preferred embodiment, the AC-DC buck converter 440 comprises a rectification circuit 441, an AC-DC conversion circuit 442 electrically connected with the rectification circuit 441 and a DC-DC buck circuit 443 electrically connected with the AC-DC conversion circuit 442, an input side of the rectification circuit 441 being provided for electrically connecting to the external power source 50 and an output side of the DC-DC buck circuit 443 being electrically connected with the main control unit 410.

Preferably, the PCB board 202 is further provided with an USB interface 204, which is disposed inside an opening 101 formed on a sidewall of the front housing and electrically connected to an output side of the AC-DC conversion circuit 442. Preferably, the lamp holder further comprises a rubber plug 102 provided for inserting into the opening 101 to cover the USB interface 204.

Preferably, the PCB board 202 is further provided with an AC voltage sensing circuit 450, an input side of which is provided for electrically connecting to the external power source 50 and an output side of which is electrically connected to the main control unit 410. In this preferred embodiment, the AC voltage sensing circuit 450 comprises an isolation device 451 and a voltage sampling circuit 452 electrically connected with the isolation device 451, an input side of the isolation device 451 being provided to electrically connect with the external power source 50 and an output side of the voltage sampling circuit 452 being electrically connected to the main control unit 410. By means of the AC voltage sensing circuit 450, the main control unit 410 can obtain a real-time voltage in the circuit and send it in real time to the user by the wireless communication module 430.

Preferably, the PCB board 202 is further provided with a MFI authentication chip 460, which is connected with the main control unit 410. In this embodiment, the MFI authentication chip 460 is provided to satisfy the need of iPhone and iPad.

Based on the above configuration, the lamp holder can electrically connect to the external power source 50 (such as AC 100V-240V) by the connection between the second connecting cap and the external lamp socket, and it also can electrically connect to the lamp 60 by the connection between the first connecting cap and the lamp 60. The power source AC 100V-240V outputs to the AC-DC buck converter 440, the AC voltage sensing circuit 450 and the switch circuit 420, simultaneously. By means of the rectification circuit 441 and the AC-DC conversion circuit 442, a DC voltage of 5V is outputted to the USB interface so that the lamp holder of the present invention can supply power to an external device via the USB interface. Due to the DC-DC buck circuit, DC voltage of 5V is reduced to 3.3V so as to be supplied to the MCU, WIFI module 431 and Bluetooth module 432. Another output of the power source AC 100V-240V is supplied to the lamp 60 via the switch circuit 420 (SCR) which is controlled by the MCU. Thus, the switch control and brightness adjustment of the lamp 60 can be controlled by a user of the external mobile terminal.

Understandably, the intelligent lamp holder could be applied to indoor and outdoor lighting and it is capable of connecting many devices, such as camera, motion detector, weather station, 2-way talk communication device, etc.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A lamp holder, comprising a front housing, a rear housing detachably connected to one end of the front housing, an end cap detachably connected to the other end of the front housing and a first connecting cap provided in the rear housing for connecting with a lamp, wherein the lamp holder further comprises a compression spring, a conducting sheet and a conducting pole for contacting with an external power source; the end cap has an axial through hole formed thereon and a limiting block formed on inner wall of the through hole for limiting the conducting pole; the conducting pole has a limiting ring formed thereon; one end of the conducting pole passes through the through hole, and the other end of the conducting pole is sleeved with the compression spring; and one end of the compression spring contacts with the limiting ring and the other end of the compression spring contacts with the conducting sheet which is fixed inside the end cap.

2. The lamp holder according to claim 1, wherein further comprises a second connecting cap which is mounted on the end cap for connecting with an external lamp socket.

3. The lamp holder according to claim 2, wherein the second connecting cap is provided with external thread for connecting with the external lamp socket.

4. The lamp holder according to claim 1, wherein the first connecting cap is a cylindrical structure which is provided with internal thread therein, and a resilient sheet is fixed to an end of the first connecting cap for contacting with the lamp.

5. The lamp holder according to claim 1, wherein further comprises a PCB board which is disposed inside a receiving chamber formed by the front housing and the rear housing together and is fixed to an end face of the rear housing.

6. The lamp holder according to claim 5, wherein the PCB board is provided with a main control unit and a switch circuit electrically connected with the main control unit and controlled by a PWM control signal from the main control unit, the switch circuit having an input side provided for electrically connecting to the external power source and an output side provided for electrically connecting to the lamp.

7. The lamp holder according to claim 6, wherein the switch circuit is silicon controlled rectifier.

8. The lamp holder according to claim 6, wherein the PCB board is further provided with a wireless communication module, which is electrically connected with and controlled by the main control unit.

9. The lamp holder according to claim 8, wherein the wireless communication module comprises at least one of a WIFI module and a Bluetooth module.

10. The lamp holder according to claim 6, wherein the PCB board is further provided with an AC-DC buck converter, an input side of which is provided for electrically connecting to the external power source and an output side of which is electrically connected to the main control unit.

11. The lamp holder according to claim 10, wherein the AC-DC buck converter comprises a rectification circuit, an AC-DC conversion circuit electrically connected with the rectification circuit and a DC-DC buck circuit electrically connected with the AC-DC conversion circuit, an input side of the rectification circuit being provided for electrically connecting to the external power source and an output side of the DC-DC buck circuit being electrically connected with the main control unit.

12. The lamp holder according to claim 11, wherein the PCB board is further provided with an USB interface, which is disposed inside an opening formed on a sidewall of the front housing and electrically connected to an output side of the AC-DC conversion circuit.

13. The lamp holder according to claim 12, wherein further comprises a rubber plug provided for inserting into the opening to cover the USB interface.

14. The lamp holder according to claim 6, wherein the PCB board is further provided with an AC voltage sensing circuit, an input side of which is provided for electrically connecting to the external power source and an output side of which is electrically connected to the main control unit.

15. The lamp holder according to claim 14, wherein the AC voltage sensing circuit comprises an isolation device and a voltage sampling circuit electrically connected with the isolation device, an input side of the isolation device being provided to electrically connect with the external power source and an output side of the voltage sampling circuit being electrically connected to the main control unit.

16. The lamp holder according to claim 6, wherein the PCB board is further provided with a MFI authentication chip, which is connected with the main control unit.

17. The lamp holder according to claim 6, wherein the main control unit is a microcontroller.

* * * * *